US007486251B2

(12) United States Patent
Chan

(10) Patent No.: US 7,486,251 B2
(45) Date of Patent: Feb. 3, 2009

(54) READILY ATTACHABLE CEILING ANTENNA HOUSING

(75) Inventor: Yat To Chan, Tauyuan Hsien (TW)

(73) Assignee: Joymax Electronics Co., Ltd., Chongli Gonyeh Chu, Chongli, Tauyuan Hsien (TW)

( * ) Notice: Subject to any disclaimer, the term of this patent is extended or adjusted under 35 U.S.C. 154(b) by 498 days.

(21) Appl. No.: 11/231,607

(22) Filed: Sep. 20, 2005

(65) Prior Publication Data

US 2007/0066325 A1 Mar. 22, 2007

(51) Int. Cl.
*H01Q 1/42* (2006.01)

(52) U.S. Cl. ..... 343/872; 343/878

(58) Field of Classification Search ..... 343/872, 343/878

See application file for complete search history.

(56) References Cited

U.S. PATENT DOCUMENTS 5,912,648 A * 6/1999 Walthers ..... 343/713
6,295,036 B1 * 9/2001 Mata et al. ..... 343/878
6,501,965 B1 12/2002 Lucidarme ..... 455/562

* cited by examiner

*Primary Examiner*—Michael C Wimer
(74) *Attorney, Agent, or Firm*—Charles E. Baxley

(57) ABSTRACT

A ceiling antenna housing includes a lower receptacle having a number of orifices, an upper receptacle disposed on the lower receptacle and having a number of cavities aligned with the orifices of the lower receptacle, an antenna member received between the lower receptacle and the upper receptacle, one or more anchoring members disposed on the upper receptacle and each having a hooking member, and a number of fasteners for securing the receptacles and the anchoring member together. The hooking members of the anchoring members may be used for engaging with hanger members typically for attaching ceiling panels to the ceiling, to attach the ceiling antenna housing to the ceiling.

2 Claims, 5 Drawing Sheets

READILY ATTACHABLE CEILING ANTENNA HOUSING

BACKGROUND OF THE INVENTION

1. Field of the Invention

The present invention relates to a ceiling antenna housing, and more particularly to a readily attachable ceiling antenna housing for easily and readily attached to the ceiling of the buildings.

2. Description of the Prior Art

Typical ceiling antenna devices may be attached to the ceiling with such as adhesive materials. However, normally, the ceiling of various buildings are made of concrete materials and/or painted with a painting layer, or covered with a wall paper, to which the typical ceiling antenna devices may not be solidly or firmly attached or secured thereto.

For example, U.S. Pat. No. 6,501,965 to Lucidarme discloses one of the typical ceiling antenna devices for attaching to the ceiling or to the walls with such as adhesive materials. However, the typical ceiling antenna devices may not be solidly attached or secured to the ceiling or to the walls with the adhesive materials, and may be easily disengaged from the ceiling or the walls.

For solidly or firmly securing the typical ceiling antenna devices to the ceiling or to the walls of various buildings, a number of holes are required to be drilled into the ceiling or the walls, for engaging the fasteners into the ceiling or the walls, and thus for allowing the typical ceiling antenna devices to be attached or secured onto the ceiling or the walls of various buildings. However, it will be difficult for the users to drill the holes into the ceiling or the walls by themselves.

The present invention has arisen to mitigate and/or obviate the afore-described disadvantages of the conventional ceiling antenna housings.

SUMMARY OF THE INVENTION

The primary objective of the present invention is to provide a ceiling antenna housing for readily attaching to the ceiling of the buildings without drilling holes into the ceiling or the walls by the users themselves.

In accordance with one aspect of the invention, there is provided a ceiling antenna housing comprising a lower receptacle including a chamber formed therein, and including a number of orifices formed therein, an upper receptacle disposed on the lower receptacle, and including a number of cavities formed therein and aligned with the orifices of the lower receptacle, an antenna member received between the lower receptacle and the upper receptacle, at least one anchoring member disposed on the upper receptacle, and including a hooking member provided thereon, and a securing device provided for securing the lower receptacle and the upper receptacle and the anchoring member together. The hooking member of the anchoring member is provided for engaging with hanger members typically for attaching ceiling panels to a ceiling, and for attaching the ceiling antenna housing to the ceiling.

The securing device includes a number of fasteners engaged through the orifices of the lower receptacle and the cavities of the upper receptacle, and engaged with the anchoring member, for securing the lower receptacle and the upper receptacle and the anchoring member together.

The fasteners each includes an enlarged head for engaging with the lower receptacle and for anchoring the fasteners to the lower receptacle. The lower receptacle includes a number of studs extended therefrom to form and define the orifices thereof.

The upper receptacle includes at least one aperture formed therein, the anchoring member includes an anchoring end for engaging into the aperture of the upper receptacle. The upper receptacle includes at least one lock notch formed therein and communicating with the aperture thereof, for receiving the anchoring end of the anchoring member. The upper receptacle includes at least one projection extended therefrom to define the lock notch thereof.

The anchoring member includes an anchoring arm extended therefrom, for engaging with beams provided between the ceiling panels. The anchoring arm of the anchoring member is located opposite to the hooking member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
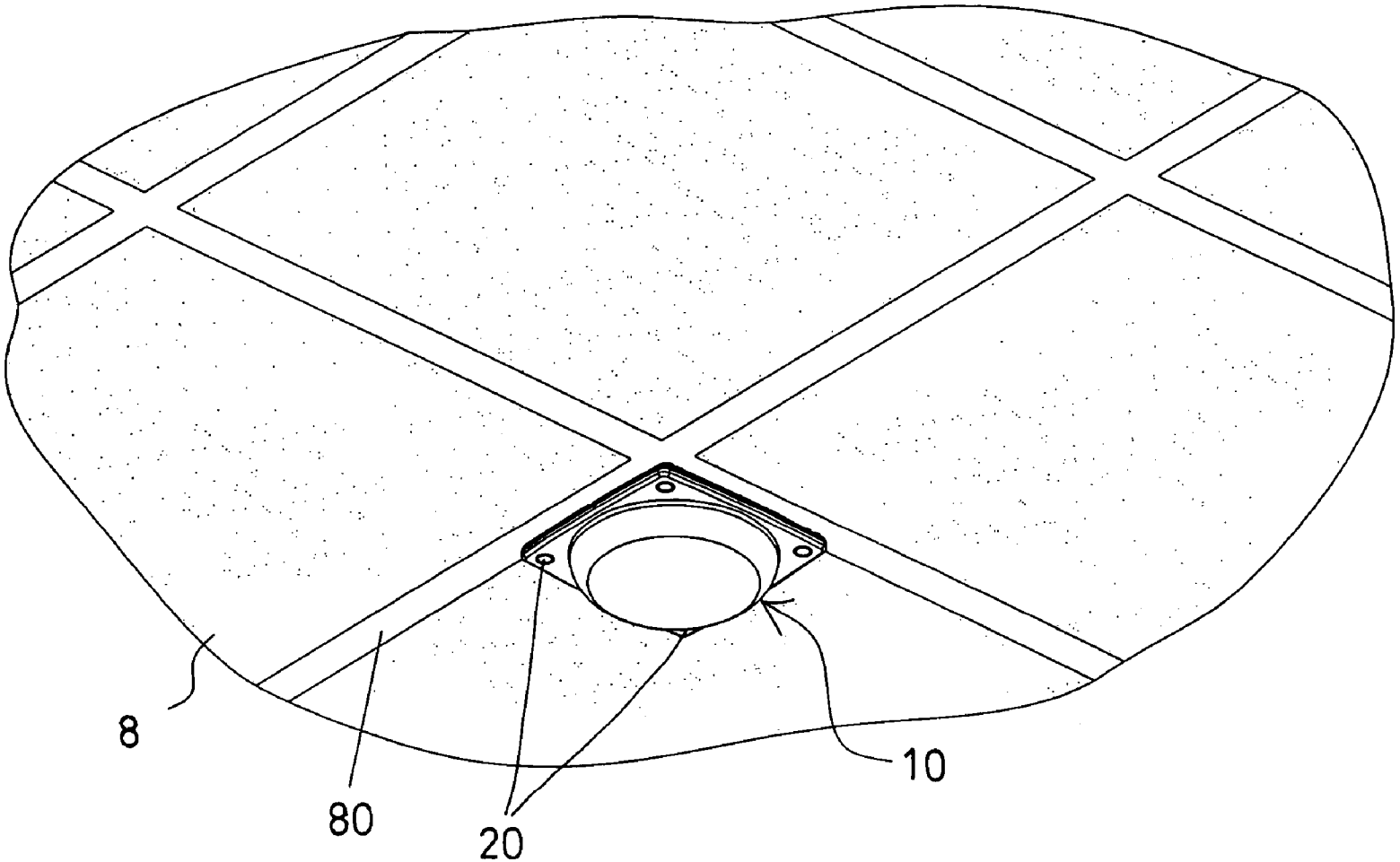
FIG. 1 is a bottom perspective view of a ceiling antenna housing in accordance with the present invention, for attaching to a ceiling of a house building.

Referring to the drawings, and initially to FIGS. 1-4, a ceiling antenna housing 10 in accordance with the present invention comprises a lower receptacle 11 including a chamber 12 formed therein for receiving or covering or shielding an antenna member 13 therein (FIG. 3), and including a recess 14 formed in the upper portion thereof and defined by an outer peripheral wall 15, and including a number of orifices 16 formed therein and defined by studs 17, for receiving fasteners 20 therein respectively. For example, the fasteners 20 each includes an enlarged head 21 formed or provided on one end or lower end thereof, for engaging with the lower receptacle 11 (FIG. 3), and for anchoring the fasteners 20 to the lower receptacle 11.

The ceiling antenna housing 10 further includes an upper receptacle 30 attached or engaged onto the lower receptacle 11, such as engaged onto the outer peripheral wall 15 of the lower receptacle 11, and having a number of cavities 31 formed therein and aligned with the orifices 16 of the lower receptacle 11, for receiving fasteners 20 therein, and a number of lock nuts 23 may be threaded to the fasteners 20, for solidly and/or detachably locking or securing the upper receptacle 30 to the lower receptacle 11.

Figure 4:
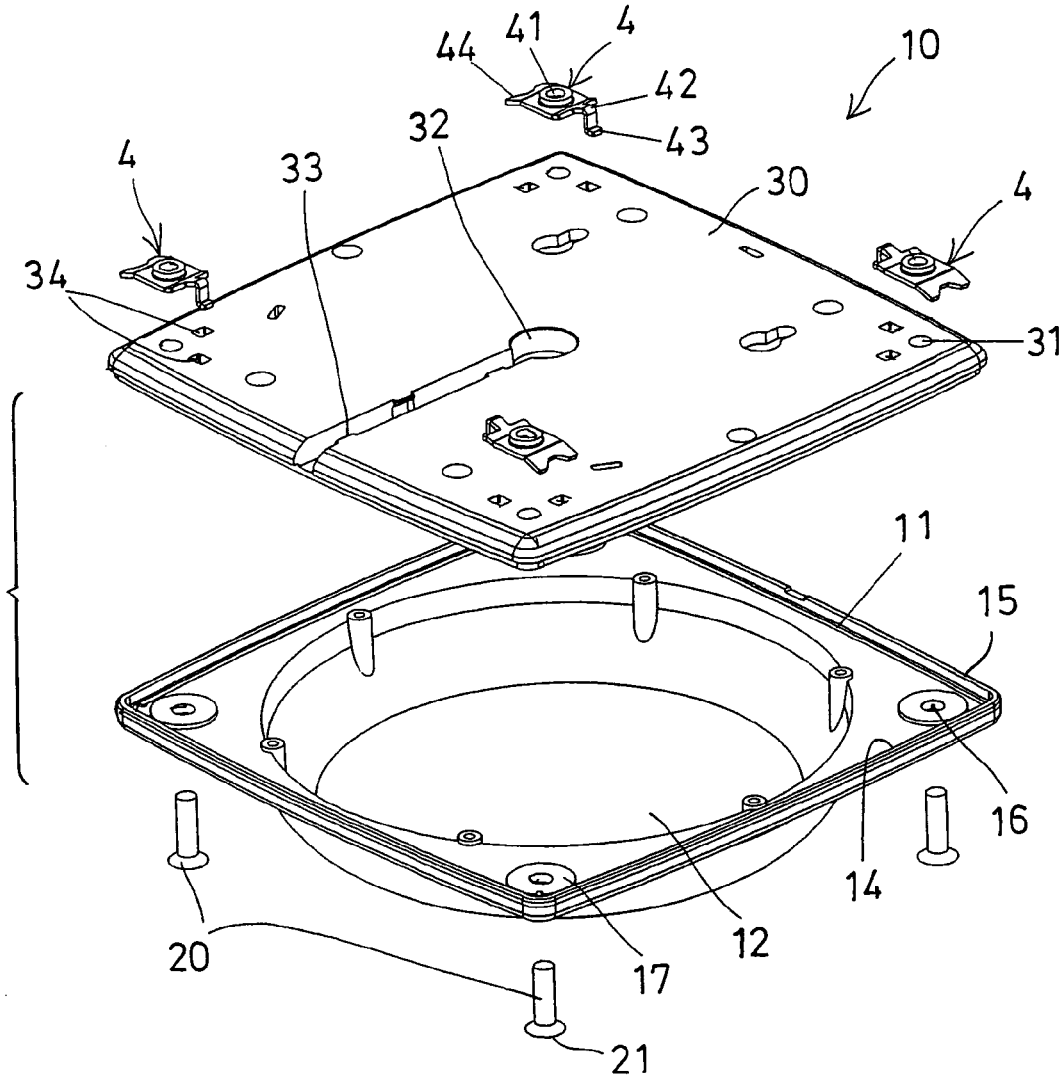
FIG. 4 is a partial exploded view of the ceiling antenna housing.
Figure 5:
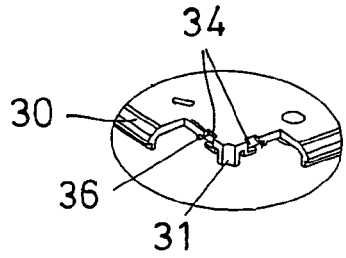
FIG. 5 is an enlarged partial perspective view of the ceiling antenna housing.
Figure 6:
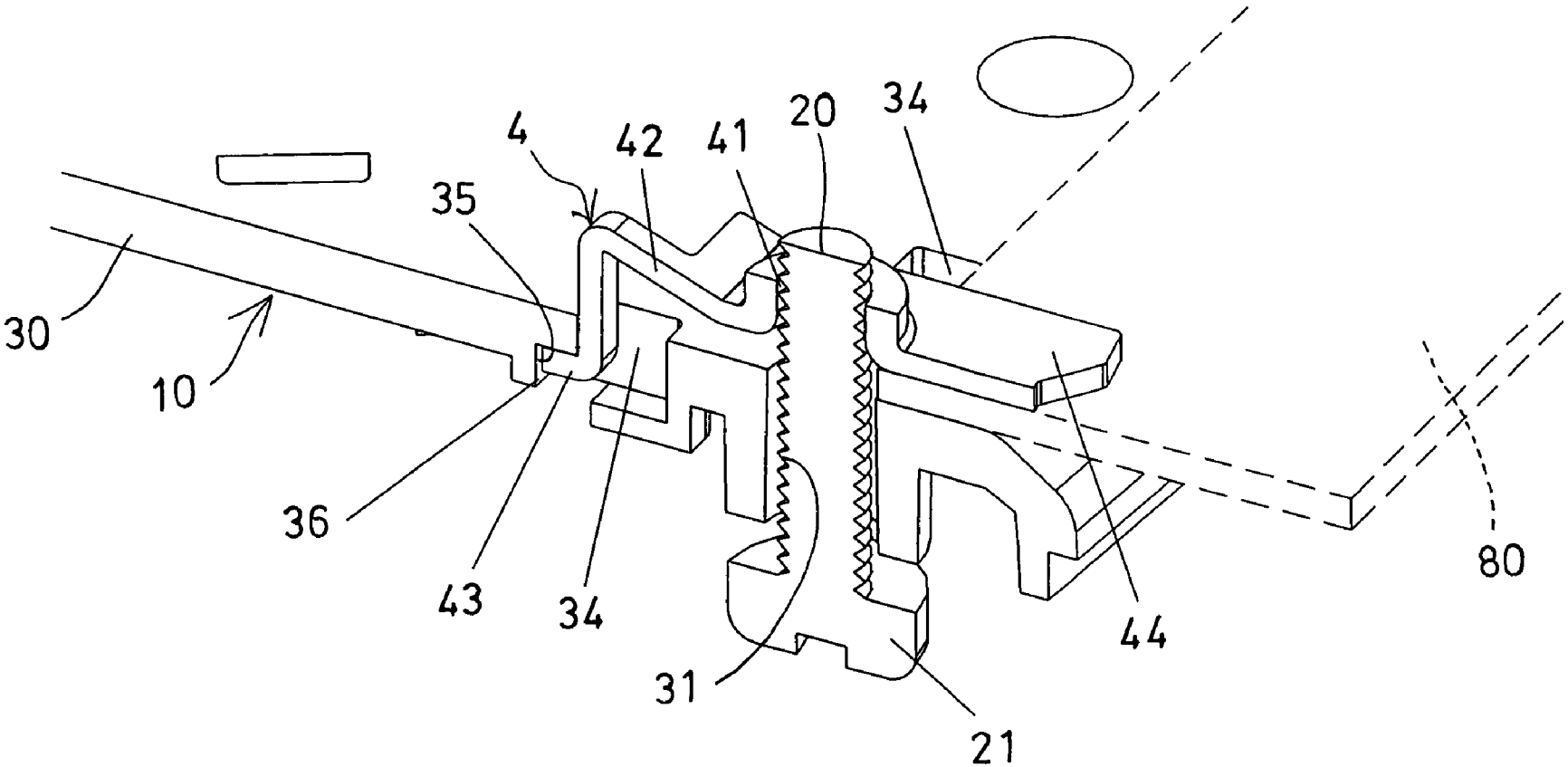
FIG. 6 is another enlarged partial perspective view of the ceiling antenna housing.

The upper receptacle 30 may further include an opening 32 formed therein, and a channel or passage 33 formed therein and communicating with the opening 32 thereof, for receiving electric wires or cables (not shown) therein. As best shown in FIGS. 4-6, the upper receptacle 30 further includes one or more apertures 34 formed therein and located beside or around each of the cavities 31 thereof, and includes one or more lock notches 35 formed therein and communicating with the apertures 34 thereof respectively, and each defined by a projection 36.

One or more fastening or anchoring members 4 are provided and engaged onto the upper receptacle 30, and each includes a screw hole or an inner thread 31 formed therein for threading with the fasteners 20 respectively, and thus for securing onto the upper receptacle 30, and each includes a hooking member 42 provided thereon or extended therefrom and having one or free end or bent or anchoring end 43 for engaging into the respective apertures 34 and for engaging with the lock notches 35 of the upper receptacle 30 respectively, and thus for solidly securing or anchoring the anchoring members 4 to the upper receptacle 30, and for preventing the anchoring members 4 from being disengaged from the upper receptacle 30.

Figure 2:
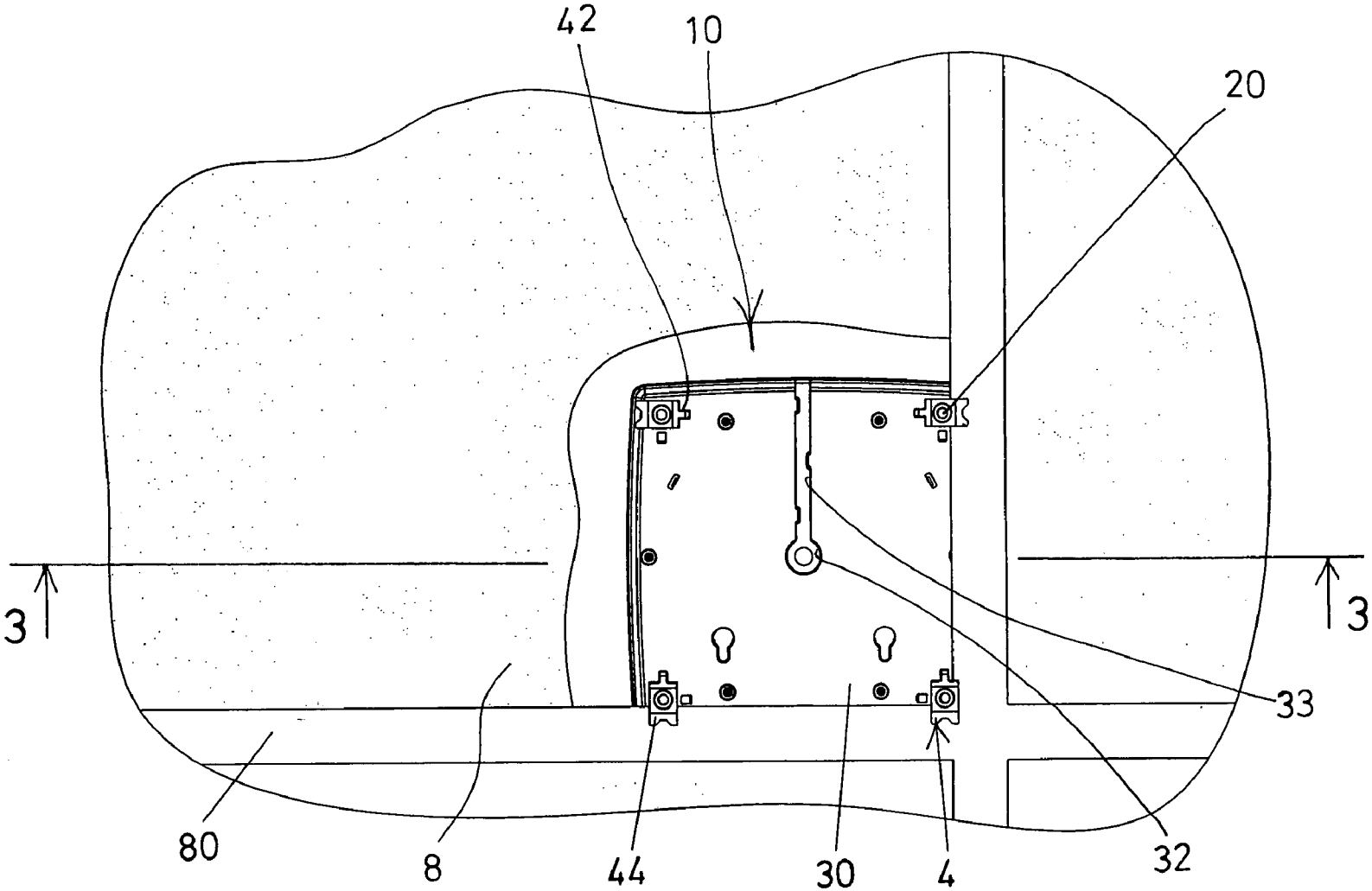
FIG. 2 is an upper plan schematic view illustrating the application of the ceiling antenna housing.
Figure 3:
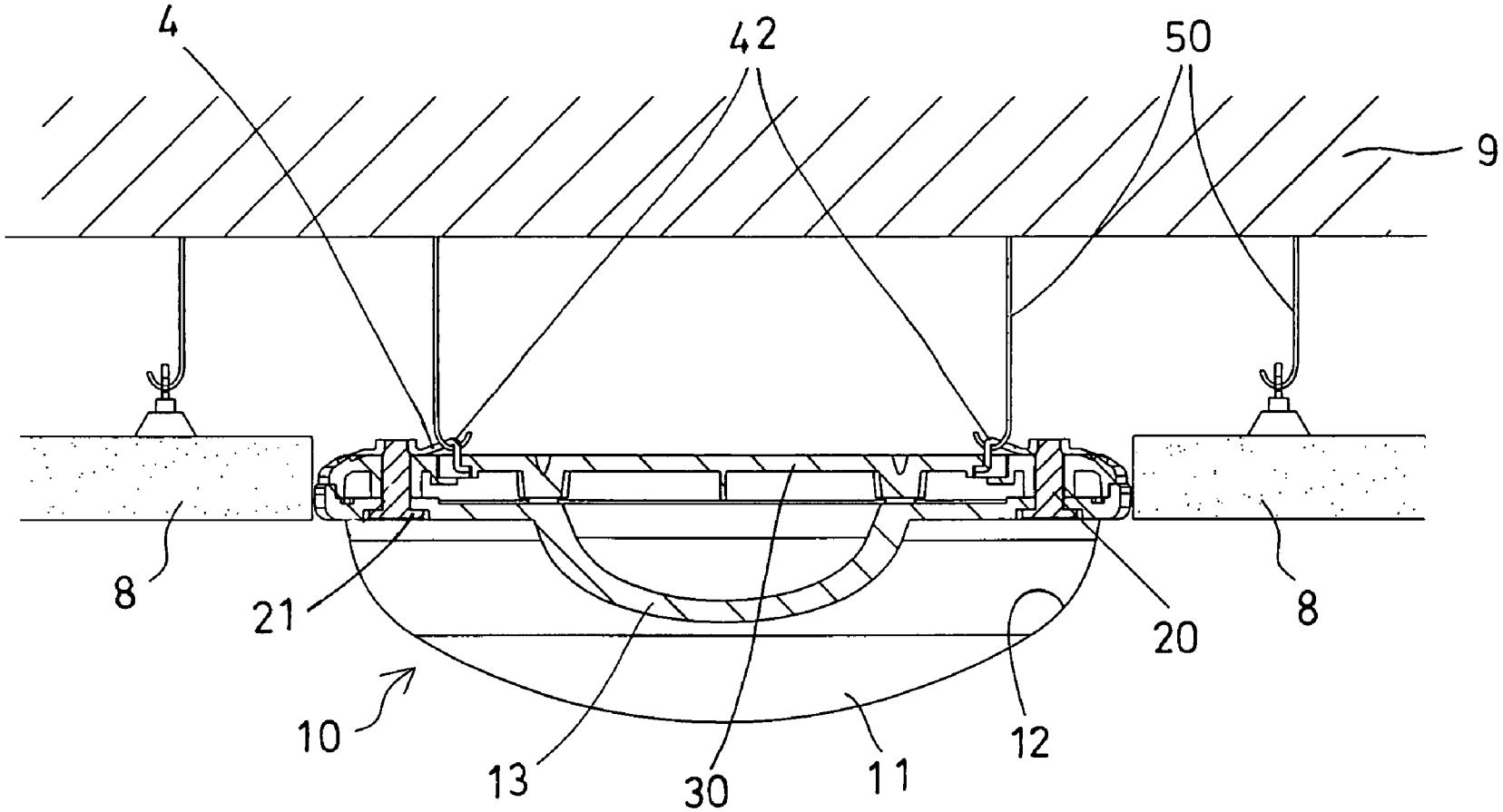
FIG. 3 is a partial cross sectional view taken along lines 3-3 of FIG. 2.

In operation, as shown in FIGS. 1-3, the hanger members 50 that are typically used for hooking or attaching the ceiling panels 8 to the ceiling 9 may also be used and may be engaged through or engaged with the hooking members 42 of the anchoring members 4 (FIG. 3), for attaching or securing the ceiling antenna housing 10 to the ceiling 9 or the walls of the buildings without drilling holes into the ceiling 9 or the walls by the users themselves. The anchoring members 4 each includes an anchoring arm 44 extended therefrom and preferably extended or located opposite to the hooking members 42, for engaging with the rails or beams 80 that are provided and disposed between the ceiling panels 8, best shown in FIG. 6, in order to anchor or position the ceiling antenna housing 10 to the rails or beams 80.

The fasteners 20 may thus be used to lock or secure the upper receptacle 30 and the lower receptacle 11 and the anchoring members 4 together, and the ceiling antenna housing 10 may be easily and readily attached or secured to the ceiling 9, without drilling holes, with the hanger members 50 that are typically used for hooking or attaching the ceiling panels 8 to the ceiling 9. The antenna member 13 may be secured or attached to either the upper receptacle 30 or the lower receptacle 11, or received or disposed between the upper receptacle 30 and the lower receptacle 11.

Accordingly, the ceiling antenna housing in accordance with the present invention may be used for readily attaching to the ceiling of the buildings without drilling holes into the ceiling or the walls by the users themselves.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A ceiling antenna housing comprising:

a lower receptacle including a chamber formed therein, and including a plurality of orifices formed therein, an upper receptacle disposed on said lower receptacle, and including a plurality of cavities formed therein and aligned with said orifices of said lower receptacle, said upper receptacle including a plurality of apertures formed therein and including a plurality of lock notches formed therein and communicating with said apertures thereof, and including a plurality of projections extended therefrom to define said lock notches thereof, an antenna member received between said lower receptacle and said upper receptacle, a plurality of anchoring members disposed on said upper receptacle, and each including a hooking member provided thereon, and each including an anchoring end for engaging into said apertures of said upper receptacle and for engaging with said lock notches of said upper receptacle, and each including an anchoring arm extended therefrom and opposite to said hooking member for engaging with beams provided between ceiling panels, and means for securing said lower receptacle and said upper receptacle and said anchoring members together, and said securing means including a plurality of fasteners engaged through said orifices of said lower receptacle and said cavities of said upper receptacle, and engaged with said anchoring members for securing said lower receptacle and said upper receptacle and said anchoring members together, said fasteners each including an enlarged head provided thereon for engaging with said lower receptacle and for anchoring said fasteners to said lower receptacle, and said hooking members of said anchoring members being provided for engaging with hanger members for attaching the ceiling panels to a ceiling.

2. The ceiling antenna housing as claimed in claim 1, wherein said lower receptacle includes a plurality of studs extended therefrom to form and define said orifices thereof.

* * * * *